US006766735B1

(12) United States Patent
Pankow

(10) Patent No.: US 6,766,735 B1
(45) Date of Patent: Jul. 27, 2004

(54) PRINTING APPARATUS FOR OBJECTS TO BE PRINTED

(75) Inventor: Martin Pankow, Mössingen/Talhelm (DE)

(73) Assignee: Heinz Walz GmbH, Pfulingen (DE)

( * ) Notice: Subject to any disclaimer, the term of this patent is extended or adjusted under 35 U.S.C. 154(b) by 0 days.

(21) Appl. No.: 10/461,134

(22) Filed: Jun. 13, 2003

(30) Foreign Application Priority Data

May 5, 2003 (DE) ..... 103 20 101

(51) Int. Cl.[7] ..... B41F 15/04
(52) U.S. Cl. ..... 101/115; 101/126
(58) Field of Search ..... 101/114–116, 126–128.1, 101/123

(56) References Cited

U.S. PATENT DOCUMENTS 4,583,458 A * 4/1986 Beachum ..... 101/126
4,669,378 A * 6/1987 Lee ..... 101/115
4,909,142 A * 3/1990 Bubley ..... 101/115
4,934,263 A * 6/1990 Eppinger ..... 101/115
5,226,362 A * 7/1993 Iaccino et al. ..... 101/129
5,626,074 A * 5/1997 Zelko ..... 101/115
5,784,956 A * 7/1998 Walz ..... 101/115

* cited by examiner

*Primary Examiner*—Minh Chau

(57) ABSTRACT

Printing apparatus for objects to be printed, in particular textile objects, ceramic, paper, plastic or the like, having a circular indexing table which rotates about a vertical axis and has a rotary drive, having at least one pallet carrier arranged on the circular indexing table and in each case having a pallet that can be arranged on the pallet carrier, at least one printing unit arranged above the pallets circulating around the vertical axis, the printing unit and the pallet being arranged such that they can move relative to each other in the vertical direction, and the pallet carrier arranged on the circular indexing table assuming a plurality of electrically indexable, stepwise predefinable rotary positions with respect to the printing unit.

15 Claims, 3 Drawing Sheets

PRINTING APPARATUS FOR OBJECTS TO BE PRINTED

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

FIELD OF THE INVENTION

The invention relates to a printing apparatus for objects to be printed, of the generic type having a circular indexing table which rotates about a vertical axis and has a rotary drive, having at least one pallet carrier arranged on the circular indexing table and in each case having a pallet that can be arranged on the pallet carrier, at least one printing unit arranged above the pallets circulating around the vertical axis, the printing unit and the pallet being arranged such that they can move relative to each other in the vertical direction, and the pallet carrier arranged on the circular indexing table assuming a plurality of electrically indexable, stepwise predefinable rotary positions with respect to the printing unit.

DESCRIPTION OF THE RELATED ART INCLUDING INFORMATION DISCLOSED UNDER 37 CFR 1.97 AND 1.98

In order to print objects, in particular T-shirts or textiles, these are fixed to pallets which are arranged on a circular indexing table in the form of a carousel which has a plurality of pallet carriers and rotates about a vertical axis. Above the pallets, at least one printing unit is arranged coaxially with the vertical axis. By means of a lifting apparatus, the pallets and the printing unit can be moved vertically relative to each other, so that an object can be printed by moving the pallet and printing unit together.

In order to apply multicolour prints to an object, for example in the screen printing process, it is necessary, in order to obtain a specific colour, for the respective primary colours to be applied to the object one after another and as precisely above one another as possible in operations which proceed one after another. The precise application of a plurality of printing inks one after another is referred to as register accuracy.

In the known printing apparatuses of the generic type, the individual rotary positions, in which in each case a printing unit for an individual colour, a drying device, a feeder station or a discharge station for the objects to be printed are arranged, are moved to little by little at constant rotational speed. For this purpose, use is made of external sensors which monitor and control the horizontal positioning of the printing units relative to the circular indexing table. The production of such a printing apparatus is very expensive and the maintenance is very costly, since the sensors and transmitters used are casily contarninated. Furthermore, in the known printing apparatuses of the generic type, it is disadvantageous that the individual rotary positions have to be moved to little by little at constant speed, the residence time in the respective positions being predefined by the position to be moved through most slowly.

BRIEF SUMMARY OF THE INVENTION

The invention is therefore based on the object of providing a printing apparatus in which, firstly, a relatively high operating speed is possible and, secondly, the expenditure on maintenance and the susceptibility to faults are reduced considerably.

DETAILED DESCRIPTION OF THE INVENTION

The printing apparatus according to the invention of the generic type of the main claim, as compared with the prior art, has the advantage that the rotary drive has an electric motor, the electric motor being an asynchronous motor or a servo motor which is connected to a frequency converter or to a servo converter, so that the rotational speed and the direction of rotation of the electric motor can be controlled by a control apparatus, by the frequency and/or the voltage of the frequency converter or of the servo converter being controlled, a rotary encoder, for example an optical, a mechanical or an inductive sensor, being arranged directly on the electric motor, preferably on its drive shaft, so that the printing apparatus and the circular indexing table can be positioned coarsely relative to each other in terms of their rotary position and, when moved vertically together, the register accuracy required for a multicolour print being achieved by means of a mechanical fine positioning apparatus arranged in at least one rotary position on the circular indexing table and on the printing unit that can be moved vertically relative thereto. The control apparatus of the printing apparatus according to the invention can in this case be programmed in such a way that the individual rotary positions can be skipped. Since all the primary colours kept ready in mutually separated printing units are not always needed for a colour to be mixed, in this way rotary stations under the printing units and having a colour that is not needed can be skipped as required, which means that the operating speed of the printing apparatus according to the invention is increased as compared with the prior art. The control of the rotary position of the circular indexing table permits the programming of the control apparatus to the effect that shorter rotary paths between rotary positions with the respective processing steps that follow after one another during printing can be shortened and in this way the operating speed of the printing apparatus can be increased. By connecting the control apparatus to the lifting device for the vertical relative movement between printing unit and circular indexing table, when individual rotary positions are skipped, the vertical relative movements are not carried out, which achieves additional acceleration of the operating speed of the printing apparatus according to the invention. As a result of using an internal rotary encoder arranged directly on the electric motor, the external sensors which were used hitherto and which, for example, need toothed belts and tensioning rollers, are dispensed with, which makes a simpler, cheaper and more reliable construction possible. As compared with the prior art, the rotary encoder arranged directly on the electric motor is better protected, has no play and needs no readjustment. The control of the frequency and/or of the voltage of the frequency converter or the servo converter allows the rotational speed to be changed during the operation of the printing apparatus according to the invention, as a result of which, for example, rapid rotation during the transport between two positions and slow rotation, for example under an infrared drying station, are possible.

One refinement of the invention provides for the motor to have a reduction gearbox, whose smaller gear meshes with a larger gear, and for the larger gear to be connected concentrically rigidly to the vertical axis of rotation of the apparatus.

Another refinement of the invention provides for the gears to have helical toothing.

An additional refinement of the invention provides for the frequency to be controllable, preferably in the range from 0 to 80 Hz.

Another, additional refinement of the invention provides for the frequency to be controllable in decade stages.

An additional refinement of the invention provides for the voltage to be controllable, preferably in a range between 1 and 10 V.

An additional refinement of the invention provides for the printing apparatus to be capable of being driven with multiple indexing, so that a plurality of rotary positions can be skipped one after another or in a specific order.

An additional refinement of the invention provides for the printing apparatus to be capable of being driven with double indexing, so that two rotary positions are skipped, it being possible for identical production sequences to proceed in adjacent rotary positions.

An additional refinement of the invention provides that, in the case of double printing systems, the stencils used in screen printing are twice as large as standard, since larger stencils are possible as a result of skipping rotary positions.

An additional refinement of the invention provides for the stencil size to be 500 mm×1000 mm in double printing systems.

Another refinement of the invention provides for the speed to be slow in intermediate printing stations.

An additional refinement of the invention provides for the printing apparatus to have twelve divisions or eight divisions or six divisions so that, on such a printing apparatus, twelve, eight or six processing stations, including the positions for the fitting and removal of the pallets, can be arranged, the mechanical mimic for the six, eight or twelve divisions being designed identically, so that in the case of different objects to be printed, it is merely necessary for a different program to be called in the control apparatus, and no time-consuming rebuilding of the mechanism is required.

BRIEF DESCRIPTION OF THE DRAWINGS

An exemplary embodiment of the printing apparatus according to the invention is illustrated in the drawing, in which.

DETAILED DESCRIPTION OF THE INVENTION

Figure 1:
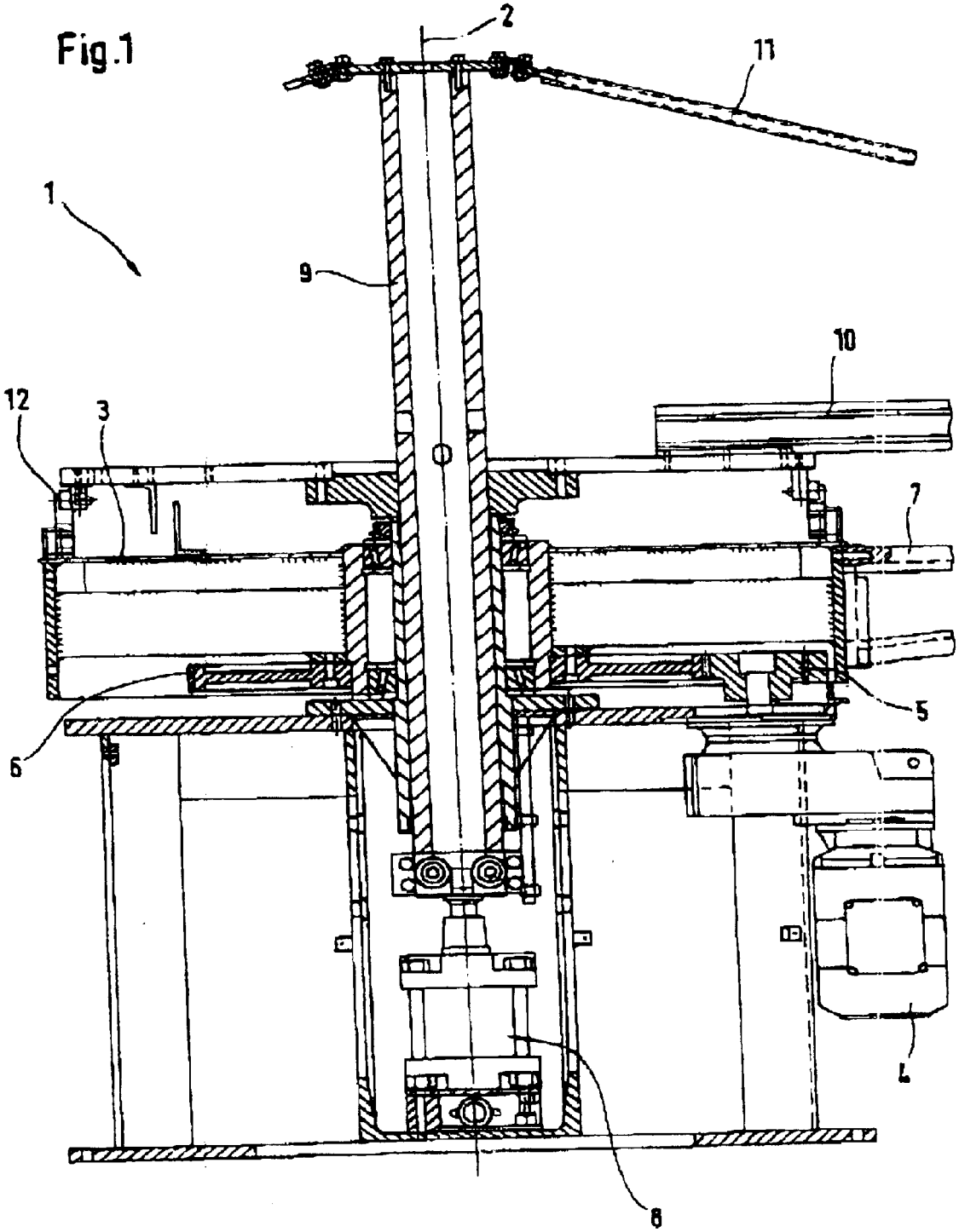
FIG. 1 shows a printing apparatus in section from the side.
Figure 2:
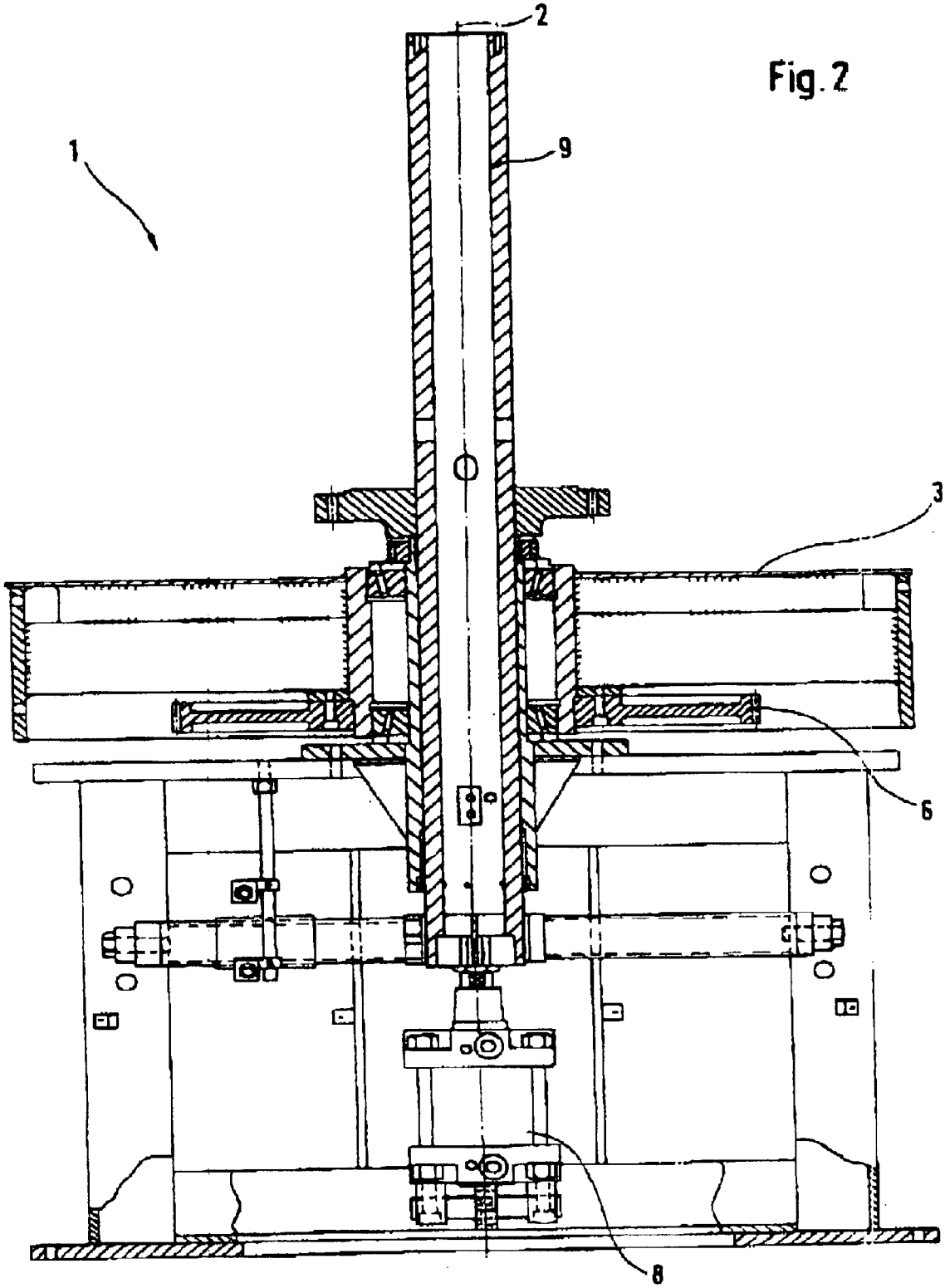
FIG. 2 shows a printing apparatus in section from the front.

The printing apparatus 1 illustrated in FIG. 1 and FIG. 2 has a circular indexing table 3 which is mounted such that it can be rotated about a vertical axis 2 and which is driven by an asynchronous motor 4. The asynchronous motor is connected to a control apparatus, not illustrated, which controls the rotational speed and the direction of rotation of the asynchronous motor 4. Arranged directly on the asynchronous motor is a rotary encoder via which, in conjunction with the lacuna, via a helically toothed pinion 5 and a likewise helically toothed internal gear 6, a predefined rotary angle of the circular indexing table 3 can be detected by the control apparatus. Arranged on the outer circumference of the circular indexing table 3 are pallet carriers 7, to whose distal ends in each case a pallet for an object to be printed can be fixed. On the vertical axis 2, underneath the circular indexing table 3, a lifting device 8 is arranged, which actuates the vertical punch 9 arranged coaxially with the vertical axis 2 of the circular indexing table 3, by which means, printing units arranged on the vertical punch 9 on printing-unit carriers 10 but not illustrated, which in addition to being supported by a carrying mechanism 11, are fixed to the upper end of the vertical punch, are moved relative to the circular indexing table and the objects to be printed arranged thereon. Arranged between the circular indexing table 3 and the printing-unit carrier 10 is a mechanical fine positioning apparatus 12 which, during the vertical moving together, positions the relative rotary position of the circular indexing table 3 with respect to the printing-unit carrier 10 exactly, so that high register accuracy is achieved during printing processes carried out one after another with different printing inks.

Figure 3:
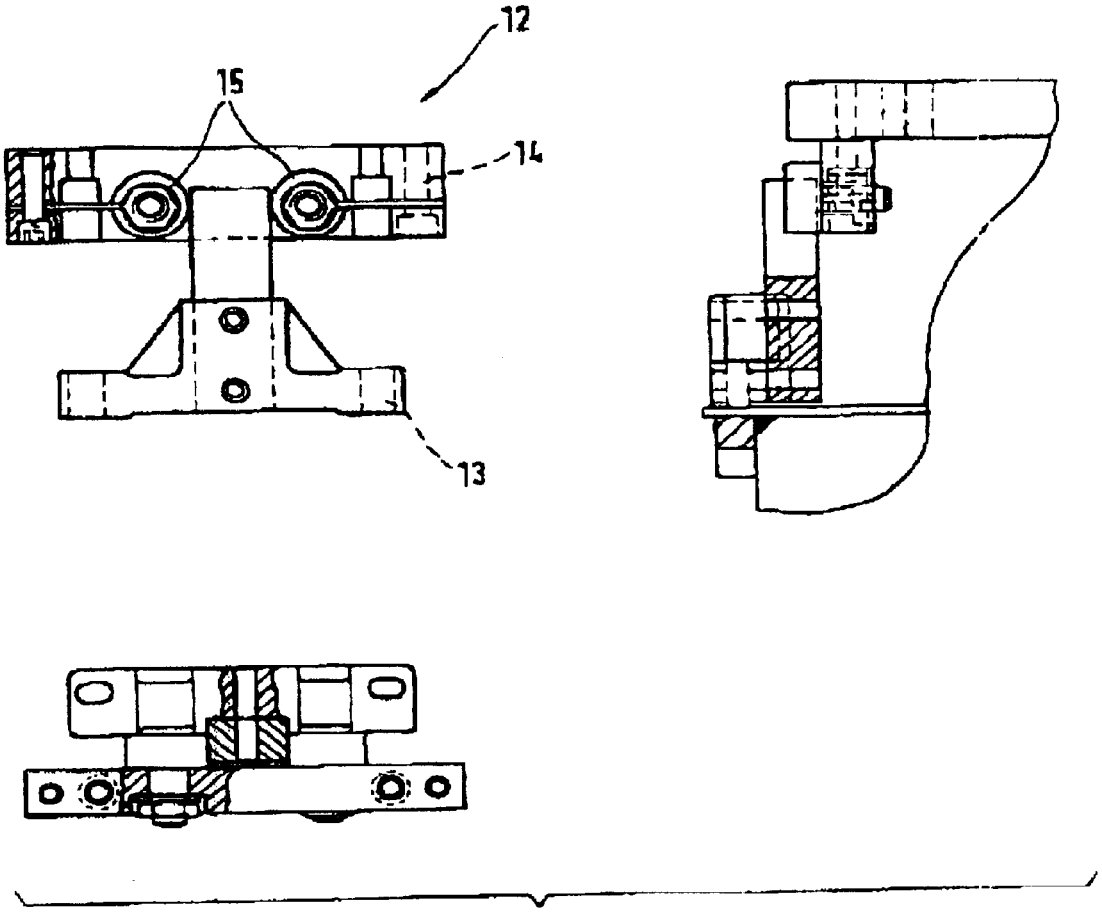
FIG. 3 shows a detail view of a mechanical fine positioning apparatus.

The fine positioning apparatus 12 illustrated in FIG. 3 comprises a pin 13 which, during the vertical moving together, moves between two rollers 15 arranged on a holder 14 and in this way permits exact positioning in the direction of the straight line connecting the two roller axes.

List of Reference Numbers

1 Printing apparatus
2 Vertical axis
3 Circular indexing table
4 Asynchronous motor
5 Pinion
6 Internal gear
7 Pallet carrier
8 Lifting device
9 Vertical punch
10 Printing-unit carrier
11 Supporting mechanism
12 Fine positioning apparatus
13 Pin
14 Holder
15 Rollers

What is claimed is:

1. Printing apparatus for objects to be printed, having a circular indexing table which rotates about a vertical axis and has a rotary drive, having at least one pallet carrier arranged on the circular indexing table and in each case having a pallet that can be arranged on the pallet carrier, at least one printing unit arranged above the pallets circulating around the vertical axis, the printing unit and the pallet being arranged such that they can move relative to each other in the vertical direction, and the pallet carrier arranged on the circular indexing table assuming a plurality of electrically indexable, stepwise predefinable rotary positions with respect to the printing unit, characterized in that the rotary drive has an electric motor, the electric motor being an asynchronous motor (4) or a servo motor, which is connected to a frequency converter or to a servo converter, in that at least one of the frequency and the voltage of the frequency converter or of the servo converter can be controlled, in that a rotary encoder is arranged directly on the electric motor, in that a control apparatus is connected to the frequency converter or the servo converter, the control apparatus being capable of being programmed in such a way that individual rotary positions can be skipped, in that, by means of the control apparatus, the electric motor can be controlled clockwise and anticlockwise, and in that, at least in one rotary position, a mechanical fine positioning apparatus (12) is arranged on the circular indexing table (3) and on the printing-unit carrier (10) moves vertically relative thereto, in order to achieve register accuracy.

2. Printing apparatus according to claim 1, characterized in that the motor has a reduction gearbox having a smaller gear and a larger gear, whose smaller gear meshes with a larger gear, and in that the larger gear is connected concentrically rigidly to the vertical axis of rotation of the apparatus.

3. Printing apparatus according to claim 2, characterized in that the smaller gear and the larger gear have helical toothing.

4. Printing apparatus according to claim 1, characterized in that the frequency is controllable.

5. Printing apparatus according to claim 4, characterized in that the frequency is controllable in decade stages.

6. Printing apparatus according to claim 4, characterized in that the frequency is controllable in the range between 0 to 80 Hz.

7. Printing apparatus according to claim 1, characterized in that the voltage is controllable.

8. Printing apparatus according to claim 6, characterized in that the voltage is controllable in a range between 1 and 10 V.

9. Printing apparatus according to claim 1, characterized in that the printing apparatus is driven with multiple indexing.

10. Printing apparatus according to claim 1, characterized in that the printing apparatus is driven with double indexing.

11. Printing apparatus according to claim 1, characterized in that the printing apparatus comprises a double printing system having stencils, and in the case of the double printing system, the stencils are about twice as large as standard stencils.

12. Printing apparatus according to claim 1, characterized in that the printing apparatus comprises a double printing system having stencils, and in the case of the double printing system, the stencil size is 500 mm×1000 mm.

13. Printing apparatus according to claim 1, characterized in that the printing apparatus has intermediate printing stations, and a speed of the printing apparatus is slow in the intermediate printing stations.

14. Printing apparatus according to claim 1, characterized in that the printing apparatus has twelve divisions or eight divisions or six divisions.

15. Printing apparatus according to claim 1, characterized in that the printing apparatus prints textile objects, ceramic, paper, plastic or like objects to be printed.

* * * * *